US007419014B2

(12) United States Patent
Blangé

(10) Patent No.: US 7,419,014 B2
(45) Date of Patent: Sep. 2, 2008

(54) FLUID JET DRILLING TOOL

(75) Inventor: Jan-Jette Blangé, Rijswijk (NL)

(73) Assignee: Shell Oil Company, Houston, TX (US)

( * ) Notice: Subject to any disclaimer, the term of this patent is extended or adjusted under 35 U.S.C. 154(b) by 18 days.

(21) Appl. No.: 10/577,456

(22) PCT Filed: Oct. 27, 2004

(86) PCT No.: PCT/EP2004/052677

§ 371 (c)(1),
(2), (4) Date: Apr. 27, 2006

(87) PCT Pub. No.: WO2005/040546

PCT Pub. Date: May 6, 2005

(65) Prior Publication Data

US 2007/0079993 A1 Apr. 12, 2007

(30) Foreign Application Priority Data

Oct. 29, 2003 (EP) ..... 03104007
Jul. 8, 2004 (WO) ..... PCT/EP2004/051407

(51) Int. Cl.
*E21B 21/12* (2006.01)

(52) U.S. Cl. ..... 175/54; 175/424

(58) Field of Classification Search ..... 175/54, 175/67, 424, 393

See application file for complete search history.

(56) References Cited

U.S. PATENT DOCUMENTS 1,512,140 A 10/1924 Schaub
1,852,903 A 4/1932 Salmon
2,028,447 A 1/1936 Griffin ..... 166/5
2,771,269 A * 11/1956 Eckel et al. ..... 175/54
2,779,571 A 1/1957 Ortloff ..... 255/61

(Continued)

FOREIGN PATENT DOCUMENTS

CN 1367294 A 9/2002

(Continued)

OTHER PUBLICATIONS

International Search Report, PCT/EP2004/051404, dated Sep. 17, 2004.

(Continued)

*Primary Examiner*—William P Neuder

(57) ABSTRACT

The invention features an excavating device for excavating a hole in a geological formation, which excavating device includes:

a body rotatable inside the hole along a rotation axis;

a nozzle arranged on the body to jet a stream of an abrasive fluid onto a surface in the geological formation in order to generate the hole, wherein the stream has at least an radial velocity component and one parallel to the rotation axis. The excavating device further has a distance holder arranged on the body to ensure a predefined distance between the nozzle outlet and the surface; wherein the distance holder has a trumpet shaped inner surface section facing the geological formation, which trumpet shaped inner surface section is provided with an opening for allowing the stream to pass through.

The opening in the trumpet shaped inner surface section is defined by a recess that is formed in the inner surface of the wall of the distance holder, whereby the nozzle is arranged to discharge in the recess. The invention also features a distance holder such as described above.

18 Claims, 4 Drawing Sheets

U.S. PATENT DOCUMENTS

| | | | | |
|---|---|---|---|---|
| 2,868,509 | A * | 1/1959 | Williams | 175/54 |
| 2,885,184 | A * | 5/1959 | Deily et al. | 175/54 |
| 2,913,113 | A | 11/1959 | Gillette | 209/223 |
| 2,963,102 | A | 12/1960 | Smith | 175/393 |
| 3,104,719 | A | 9/1963 | Fite | 166/243 |
| 3,212,217 | A | 10/1965 | Furgason | |
| 3,375,886 | A | 4/1968 | Goodwin et al. | |
| 3,416,614 | A | 12/1968 | Good win et al. | |
| 3,489,280 | A | 1/1970 | Israelson et al. | |
| 3,508,621 | A | 4/1970 | Gaylord et al. | |
| 3,759,367 | A | 9/1973 | Elliott | 198/41 |
| 3,831,753 | A | 8/1974 | Gaylord et al. | 209/399 |
| 3,838,742 | A | 10/1974 | Juvkam-Wold | 175/380 |
| 3,854,997 | A | 12/1974 | Peck et al. | 134/7 |
| 3,897,836 | A | 8/1975 | Hall et al. | 175/93 |
| 3,938,600 | A | 2/1976 | Essmeier | 175/422 |
| 3,949,354 | A | 4/1976 | Claycomb | 340/18 |
| 3,952,857 | A | 4/1976 | Nazuka | 198/41 |
| 4,042,048 | A | 8/1977 | Schwabe | 175/380 |
| 4,055,489 | A | 10/1977 | Soley | 209/223 |
| 4,119,160 | A | 10/1978 | Summers et al. | 175/67 |
| 4,396,071 | A | 8/1983 | Stephens | 175/50 |
| 4,478,368 | A | 10/1984 | Yie | 239/430 |
| 4,534,427 | A | 8/1985 | Wang et al. | 175/67 |
| 4,550,068 | A | 10/1985 | Brooks et al. | 430/122 |
| 4,555,872 | A | 12/1985 | Yie | 51/439 |
| 4,637,479 | A | 1/1987 | Leising | 175/26 |
| 4,666,083 | A | 5/1987 | Yie | 239/8 |
| 4,688,650 | A | 8/1987 | Hayatdavoudi et al. | 175/324 |
| 4,708,214 | A | 11/1987 | Krawza et al. | 175/424 |
| 4,768,709 | A | 9/1988 | Yie | 239/8 |
| 4,787,465 | A | 11/1988 | Dickinson, III et al. | 175/67 |
| 4,872,293 | A | 10/1989 | Yasukawa, deceased et al. | 51/410 |
| 4,993,503 | A | 2/1991 | Fischer et al. | 175/62 |
| 5,018,317 | A | 5/1991 | Kiyoshige et al. | 51/410 |
| 5,098,164 | A | 3/1992 | Savanick et al. | 299/17 |
| 5,170,891 | A | 12/1992 | Barrett | 209/223.2 |
| 5,291,956 | A | 3/1994 | Mueller et al. | 175/67 |
| 5,314,030 | A | 5/1994 | Peterson et al. | 175/26 |
| 5,361,855 | A | 11/1994 | Schuermann et al. | 175/67 |
| 5,575,705 | A | 11/1996 | Yam et al. | 451/39 |
| 5,586,848 | A | 12/1996 | Suwijn | 409/137 |
| 5,664,992 | A | 9/1997 | Williams, Jr. | 451/76 |
| 5,862,871 | A | 1/1999 | Curlett | 175/340 |
| 5,887,667 | A | 3/1999 | Van Zante et al. | 175/67 |
| 5,944,123 | A | 8/1999 | Johnson | 175/73 |
| 6,062,311 | A | 5/2000 | Johnson et al. | 166/312 |
| 6,109,370 | A | 8/2000 | Gray | 175/61 |
| 6,283,833 | B1 | 9/2001 | Pao et al. | 451/40 |
| 6,412,643 | B1 | 7/2002 | Wysolmierski | 209/213 |
| 6,510,907 | B1 * | 1/2003 | Blange | 175/67 |
| 6,702,940 | B2 | 3/2004 | Blange | 210/222 |
| 7,017,684 | B2 * | 3/2006 | Blange | 175/424 |
| 2002/0079998 | A1 | 6/2002 | Blange | 335/302 |
| 2004/0094332 | A1 * | 5/2004 | Blange | 175/424 |
| 2006/0185907 | A1 * | 8/2006 | Blange | 175/424 |
| 2006/0219443 | A1 * | 10/2006 | Blange | 175/424 |

FOREIGN PATENT DOCUMENTS

| | | | |
|---|---|---|---|
| DE | 2052516 | | 4/1972 |
| DE | 2832037 | A | 1/1980 |
| DE | 4005691 | A | 8/1991 |
| DE | 19645142 | | 4/1998 |
| DE | 29803676 | | 4/1998 |
| EP | 0069530 | | 1/1983 |
| EP | 0119338 | | 9/1984 |
| EP | 0526087 | A1 | 2/1993 |
| EP | 1000663 | | 5/2000 |
| EP | 0763489 | B1 | 7/2002 |
| GB | 892905 | | 4/1962 |
| GB | 2095722 | A | 10/1982 |
| GB | 2206508 | A | 1/1989 |
| GB | 2284837 | A | 6/1995 |
| JP | 4044594 | | 2/1992 |
| JP | 08168935 | A | 7/1996 |
| RU | 2114274 | | 6/1998 |
| SU | 924334 | B | 4/1982 |
| WO | WO9922112 | | 5/1999 |
| WO | WO0066872 | | 11/2000 |
| WO | 02/34653 | | 5/2002 |
| WO | 02-092956 | | 11/2002 |
| WO | 2004/005768 | | 1/2005 |
| WO | 2005/005765 | | 1/2005 |
| WO | 2005/005766 | | 1/2005 |
| WO | 2005/005767 | | 1/2005 |
| WO | WO2005005768 | A2 | 1/2005 |
| WO | 2005/038189 | | 4/2005 |
| WO | WO2005040546 | | 5/2005 |
| WO | WO2005051426 | A1 | 6/2005 |

OTHER PUBLICATIONS

Robert D. Blevins. "Applied Fluid Dynamics Handbook", Krieger Publishing Company p. 260.

International Search Report, PCT/EP2002/02509, dated Aug. 8, 2002.

International Search Report, PCT/EP2004/051407, dated Sep. 13, 2004.

International Search Report, PCT/EP2004/052593, dated Jan. 14, 2005.

International Search Report, PCT/EP2004/051428, dated Sep. 24, 2004.

* cited by examiner

FLUID JET DRILLING TOOL

PRIORITY CLAIM AND CROSS REFERENCE

The present application is a 35 U.S.C. 371 national stage filing of PCT/EP2004/052677 filed 27 Oct. 2004, which claims benefit of European patent application No. 03104007.4 filed 29 Oct. 2003 and International patent application No. PCT/EP04/051407 filed 8 Jul. 2004.

FIELD OF THE INVENTION

The invention relates to a distance holder for use as a part of an excavating device.

The invention also relates to an excavating device, for excavating a hole in a geological formation, comprising such a distance holder.

BACKGROUND OF THE INVENTION

WO-A-02/34653 shows such an excavating device. The described excavating device uses a jet of fluid under pressure in which abrasive particles are mixed to erode the material of a surface in order to generate a hole in said surface. The jet is placed under an angle relative to the advancement direction of the excavating device in the hole, and is rotatably operated inside the hole in order to create the hole. This is shown to result in a hole with a heap-shaped center part on the bottom of the hole, as a result of the rotation of the abrasive jet.

The excavating device according to the prior art comprises a distance holder in the form of an L-shaped bracket, in order to ensure a pre-determined distance of the nozzle to the bottom of the hole. The bracket contacts the hole bottom surface in the part of the hole bottom surface that is diametrically opposed to where the abrasive jet stream impacts the hole at that very moment. When the abrasive jet leaves the nozzle outlet it enters a free space.

This may lead to misalignment of the abrasive jet stream, and thereby undesired erosion into the bore hole wall, and a less effective use of the abrasive jet and the energy contained therein.

SUMMARY OF THE INVENTION

The invention, provides a distance holder for use as a part of an excavating device arranged to generate a stream of an abrasive fluid to be jetted against a geological formation thereby excavating a hole in the geological formation, the distance holder having a wall with a trumpet shaped inner surface section to be facing the geological formation there where it is to be excavated, whereby a recess is formed in the trumpet shaped inner surface section of the wall thereby defining an opening in the trumpet shaped inner surface section to allow the stream of the abrasive fluid to pass from within the recess through the trumpet shaped inner surface section to impact the geological formation.

There is also provided an excavating device for excavating a hole in a geological formation, which excavating device comprises:

a body rotatable inside the hole along a rotation axis;

a nozzle arranged on the body to jet a stream of an abrasive fluid onto a surface in the geological formation in order to generate the hole, wherein the stream has at least a radial velocity component and one parallel to the rotation axis; and a distance holder arranged on the body to ensure a predefined distance between the nozzle outlet and the surface; wherein the distance holder has a trumpet shaped inner surface section facing the geological formation, which trumpet shaped inner surface section is provided with an opening for allowing the stream to pass through.

These and other advantages of the invention will be further elucidated by way of example and in conjunction with the accompanying drawings.

DETAILED DESCRIPTION OF EMBODIMENTS

Figure 1:
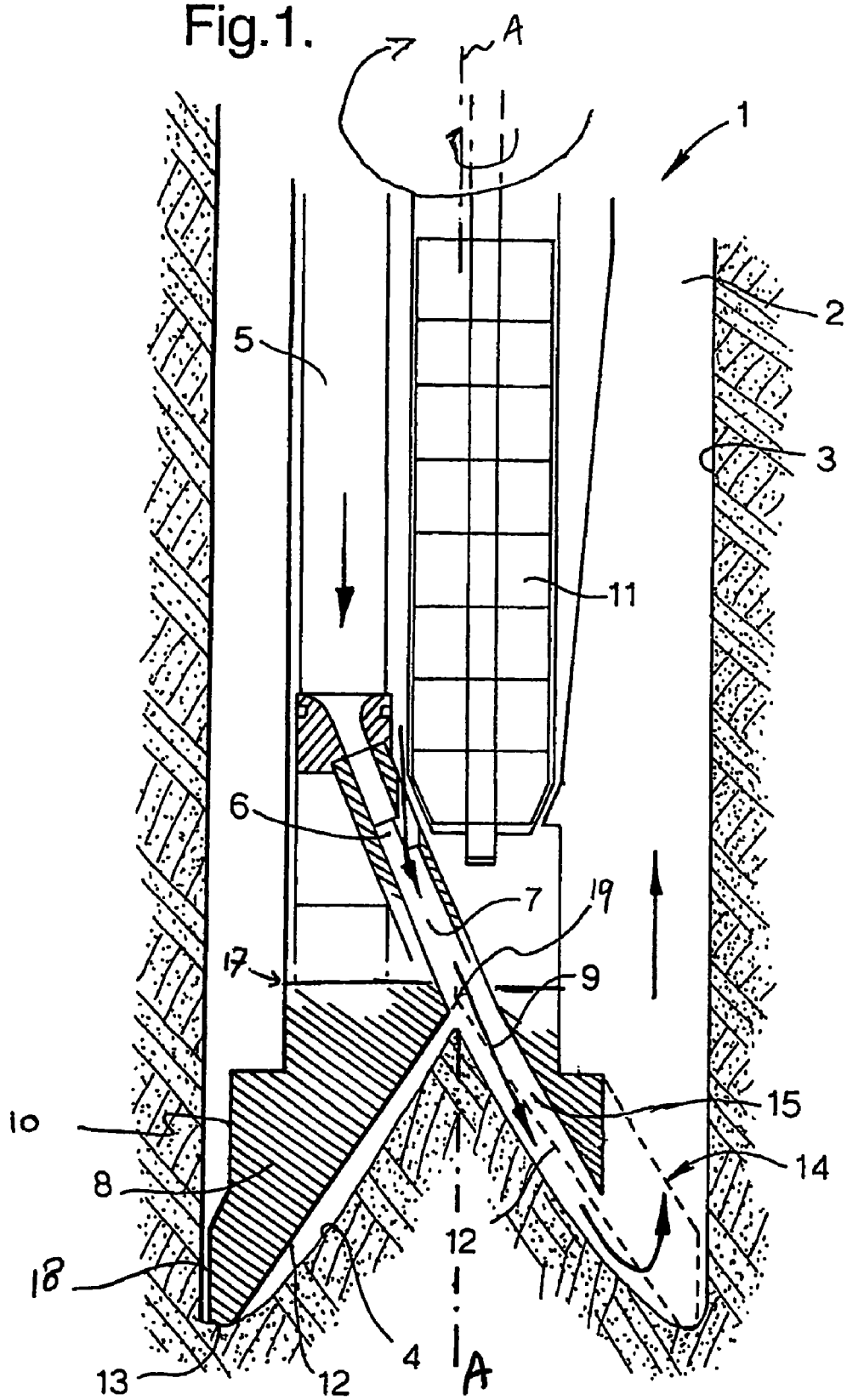
FIG. 1 schematically shows a cross section of an excavating device and distance holder according to the invention.

The present distance holder for the present excavating tool has a wall with a trumpet shaped inner surface section provided with an opening.

The trumpet shaped inner surface section is suitable to more or less match a heap-shaped bottom profile of the hole. Rotation of the excavating tool inside the hole results in the abrasive jet stream to rotate in the hole such that it is scanned along the hole. When placed over a heap-shaped bottom profile, the distance holder thus provides an improved degree of alignment of the hole bottom profile in front of the rotating abrasive jet stream.

The opening in the trumpet shaped inner surface section is preferably defined by a recess that is formed in the trumpet shaped inner surface of the wall of the distance holder, whereby the nozzle is arranged to discharge in the recess.

When placed in the hole in the geological formation over the heap-shaped bottom profile, the recess defines a tunnel for the stream of abrasive fluid to pass through. The recess thus facilitates confinement of the stream of abrasive fluid so that a relatively high density is maintained. Herewith the effectiveness of the energy present in the stream in excavating is increased.

As the space between the trumpet shaped inner surface of the distance holder and the bottom surface of the hole is limited, the abrasive jet stream now better follows the bottom surface than it would have when the jet would be discharge in open space. This increases the efficiency of the abrasive jet stream.

It is remarked that U.S. Pat. No. 2,779,571 discloses a pellet impact drill bit, having a trumpet-shaped foot part. A nozzle is located up-hole above the trumpet-shaped foot part for releasing impact pellets in open space. The foot part has a fully removed segment through which the impact pellets can pass. This removed segment is not capable of guiding or concentrating the stream of impact pellets.

The present invention, in contrast, features a recess in the form of a cavity formed in the inner surface of the distance holder's wall such that a covered passage is formed between the bottom of the hole and the recess in the wall for the abrasive jet stream to pass through. The abrasive jet stream can thus strike the heap-shaped bottom of the hole in a glancing direction, thereby abrading this surface while maintaining its heap-shaped bottom profile.

The trumpet shape in the distance holder of the present invention can be approached by any one of a number of conical shapes, preferably a straight cone or one having a concave side contour, or an outwardly tapered contour with outwardly increasing opening angles.

Preferably, the trumpet shaped inner surface converges in a centre area, whereby the opening extends to include the centre area. The centre area is best intersected by the axis of rotation, so that the excavating device can rotate about the centre area and ensure that the formation in the centre of the hole is impacted by the abrasive jet.

Preferably, the opening is an elongate shaped opening of which the direction of elongation is alignable with the discharge direction of the nozzle. This allows for a small angle of impact between the stream of abrasive fluid and the heap-shaped bottom of the hole.

Typically, a peripheral outer surface section of the distance holder is connected to the trumpet shaped inner surface section via a rim area, whereby preferably the opening in the trumpet shaped inner surface extends to the rim area. Herewith it is achieved that abrasive fluid present in the recess can escape from the recess even if the opening provided in the trumpet shaped inner surface section is fully covered by the heap-shaped bottom profile in the hole. The risk of obstructing the outflow of the abrasive jet stream from the nozzle is thus reduced.

Moreover, because the opening is provided in the trumpet shaped inner surface section, the inner surface can contact the least excavated sections of the bottom of the hole and thereby prevent longitudinal advancement of the excavating device along the axis of rotation. Thus, the arrangement of the opening in the trumpet shaped inner surface section ensures that further excavating of the hole can only occur if all of the bottom hole area is eroded. Herewith mechanical jamming of the excavating tool due to unequal distributed excavation within the hole is avoided.

The escape of abrasive fluid from the recess is further facilitated by optional provision of one or more slots in the rim area, preferably opening into a slot provided in the outer surface section, for drainage of the abrasive fluid. Herewith it is avoided that the end of the recess facing away from the nozzle is closed off by the side wall of the hole under excavation.

Preferably, the distance holder has an outer surface profile that is essentially peripheral in a lower part and that converges upward toward the body. Herewith a larger space between the bore wall and the excavating device is provided. Due to this larger space, the velocity of the fluid stream after it impacted with the geological formation is reduced, such that undesired washing out of the hole wall is reduced.

FIG. 1 shows an excavating device 1 according to the invention provided with a distance holder 8 in accordance with the invention. The excavating device 1 is inserted into a hole 2 in a geological formation, the hole 2 having a wall 3 and a generally heap shaped hole bottom surface 4.

The excavating device 1 is rotatable inside the hole along a rotation axis A. A proximal end of the excavating device 1 can be coupled onto a distal end of a standard drill string reaching into the hole 2. The excavating device 1 has a first fluid channel 5, typically in fluid communication with an internal longitudinal channel in the drill string. The first fluid channel 5 serves to transport drilling fluid through, to a mixing chamber 6 where abrasive particles are mixed with the drilling fluid to form an abrasive fluid that subsequently is ejected through a nozzle 7 in the form of an abrasive jet stream 9.

The nozzle 7 is oriented in the excavating device 1 to give the stream 9 of the abrasive fluid has at least an radial velocity component and one parallel to the rotation axis A. The effective gauge of the excavating device 1 is determined by the radial reach of the abrasive jet.

The abrasive jet stream 9 impacts the geological formation which is thereby abraded such that the hole 2 is excavated.

Figure 2A:
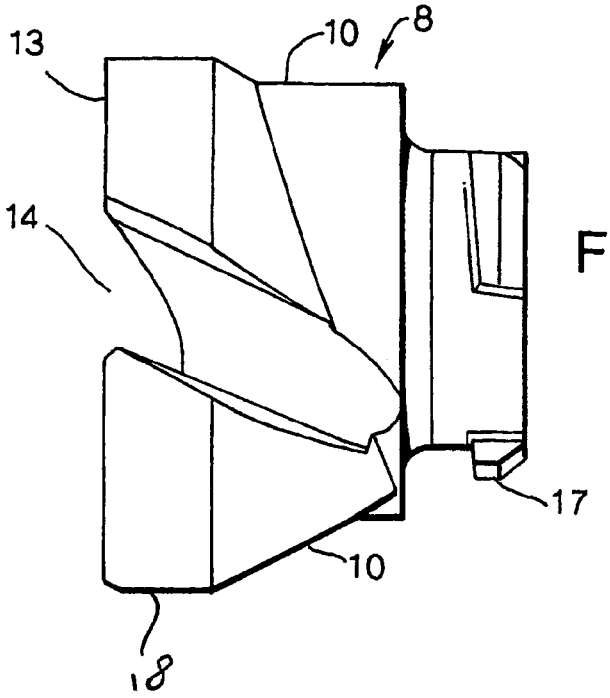
FIGS. 2A, 2B and 2C show schematic perspective views of a distance holder of an excavating device according to embodiments of the invention.
Figure 2B:
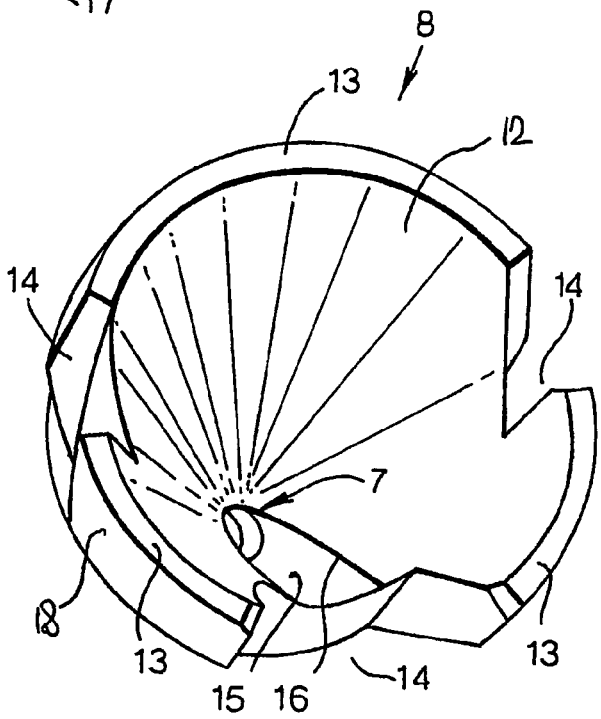
Figure 2C:
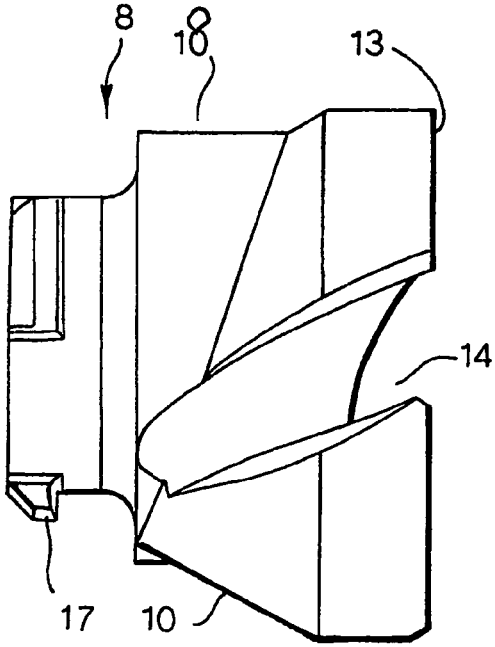

A distal end of the excavating device 1 is formed by the distance holder 8, shown in detail in different views in FIGS. 2A to 2C. The distance holder is firmly connectable to an abrasive jet stream generating tool part by means of connector 17, here provided in the form of a bayonet catch. If desired, other connector systems can be used instead such as a threaded connector as exemplified in FIG. 5. The distance holder 8 ensures, inter alia, a predetermined distance between a discharge outlet of nozzle 7 and the bottom surface 4.

The distance holder 8 has a wall with a trumpet shaped inner surface section 12 facing the bottom surface 4 of the hole 2 in the geological formation. The trumpet-shape converges in a centre area forming a central apex 19. The distance holder 8 is connectable to the abrasive jet stream generating tool part such that the axis of rotation runs through the central apex 19.

The trumpet shaped inner surface section 12 is provided with a recess 15 defining an elongate opening 16 for allowing the abrasive jet stream 9 to pass through after having been discharged from the nozzle 7. The recess forms a cavity inside the wall of the trumpet shaped inner surface section 12, of which the opening 16 forms an exit opening into the space bound by the trumpet shaped inner surface section 12. (Cavity-forming recess 15 and opening 16 are best viewed in FIG. 2B.)

The elongate opening 16 extends to include the centre area including apex 19. Alternatively, the centre area can be provided with mechanical rock-cutting elements.

Referring also to FIG. 1, the nozzle 7 is arranged to discharge into the recess 15. The recess 15 thus functions as a discharge channel. The abrasive jet stream 9 discharged from the nozzle 7 through the discharge channel 15, passes the trumped shaped inner surface section 12 through the opening 16.

Preferably, the nozzle 7 has its outlet opening arranged such that the apex 19 is located inside the nozzle 7.

The opening 16 in the trumpet shaped inner surface section 12 has an elongated shape, suitably an oval shape, parabolic shape, or elliptical shape. The direction of elongation of the opening is aligned with the discharge direction of the nozzle 7. The abrasive jet stream 9, as it passes through the opening 16, strikes glancingly along the heap-shaped bottom surface 4 of the hole, thereby abrading this surface 4. At the same time, the excavating tool is rotated in the hole, such that the hole is symmetrically excavated.

A peripheral outer surface section 18 of a general outer surface 10 is present at a radius such that a part of the abrasive jet stream 9 can reach radially outward a little bit further than the peripheral outer surface 18. The peripheral outer surface section 18 is connected to the trumpet shaped inner surface section 12 via a rim area 13, and extends around the distance holder's centre area and the axis of rotation. The rim area 13 forms substantially a support ring functioning as a contact end surface to support any weight on bit. However, since at least part of the abrasive jet 9 reaches further than the peripheral outer surface section 18, the geological formation is abraded also at a distance corresponding to where the rim area 13 is so that the excavating device 1 can progress without being blocked by unabraded geological formation.

The inner surface 12 of the distance holder may come in almost full contact with the hole bottom surface 4, for instance after an excavating interruption. To avoid a full closing off of the opening 16 in the trumpet shaped inner surface section 12 and consequently hampering of the passage of the stream 9 of the abrasive fluid, the opening 16 extends to the peripheral outer surface 18. In this case, the preferably elongated shape of the opening 16 thus is a truncated elongated shape, suitably a truncated oval shape, a truncated parabolic shape, or a truncated elliptical shape. Even when the heap shaped bottom 4 completely covers opening 16, the recess 15 always forms a tunnel to the periphery of the excavating device 1 through which the abrasive fluid can be discharged.

There may be provided three slots 14 in the contact end surface 13, which are also called junk slots. A different number of junk slots is also possible. The slots align with slots or recesses provided in the peripheral outer surface 18, for drainage of the abrasive fluid. The recess 15 in the trumpet shaped inner surface 12 of the distance holder ends in of the slots 14. During an excavating operation, the cuttings resulting from the excavating together with the abrasive jet stream 9, are discharged through slots 14.

Figure 3:
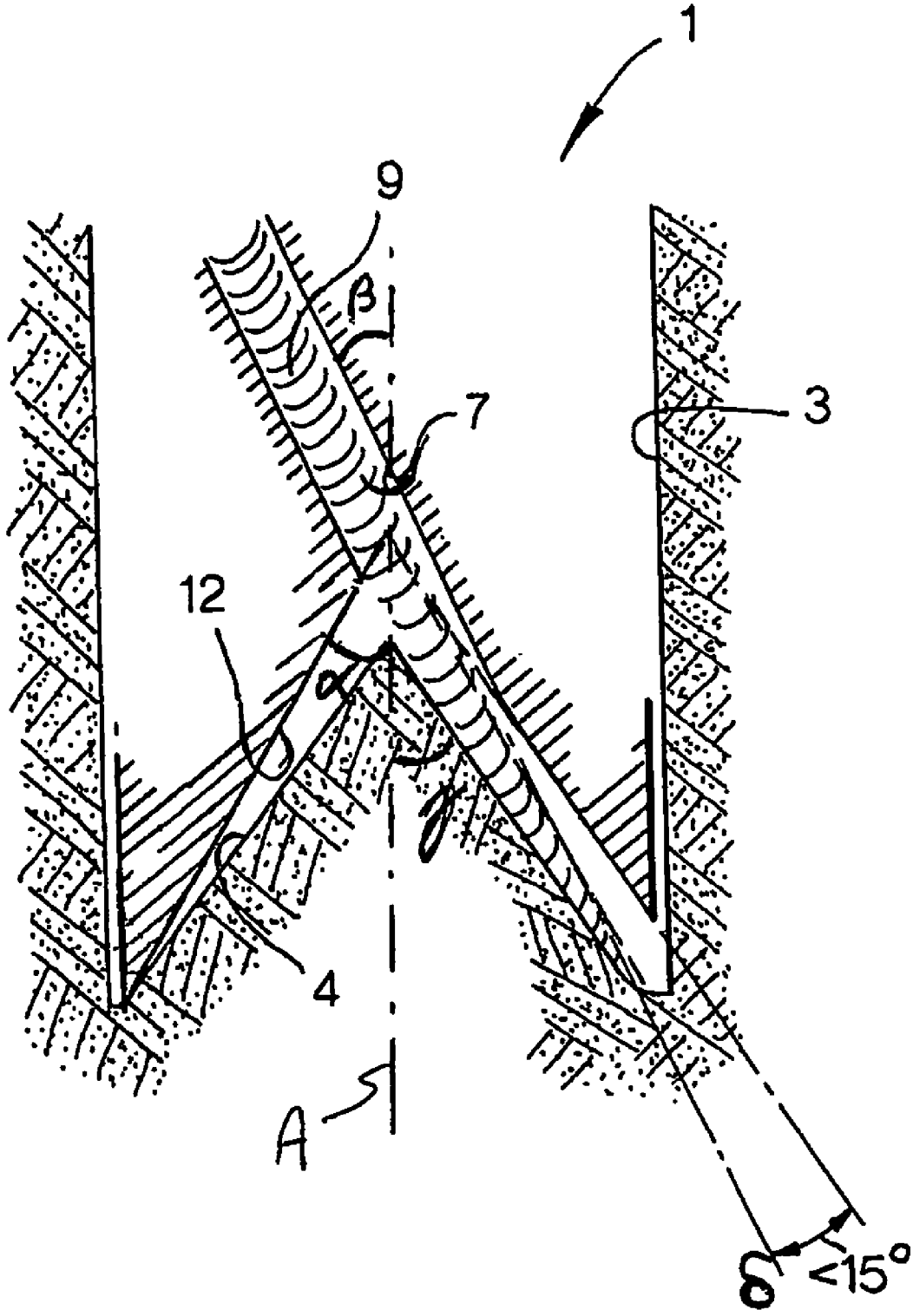
FIG. 3 shows a schematic cross sectional view for elucidating the angle between the nozzle discharge direction and the inner surface of the distance holder.

In FIG. 3 a schematic view of the lower end of the excavating device 1 with the distance holder according to the invention is shown. The trumpet shaped inner surface 12 of the distance holder 8 is shown and a typical trumpet shaped bottom surface 4. Furthermore the nozzle outlet 7 is shown. The abrasive jet 9 is discharged in a direction substantially parallel to the trumpet shaped inner surface 12 of the distance holder 8.

Figure 5:
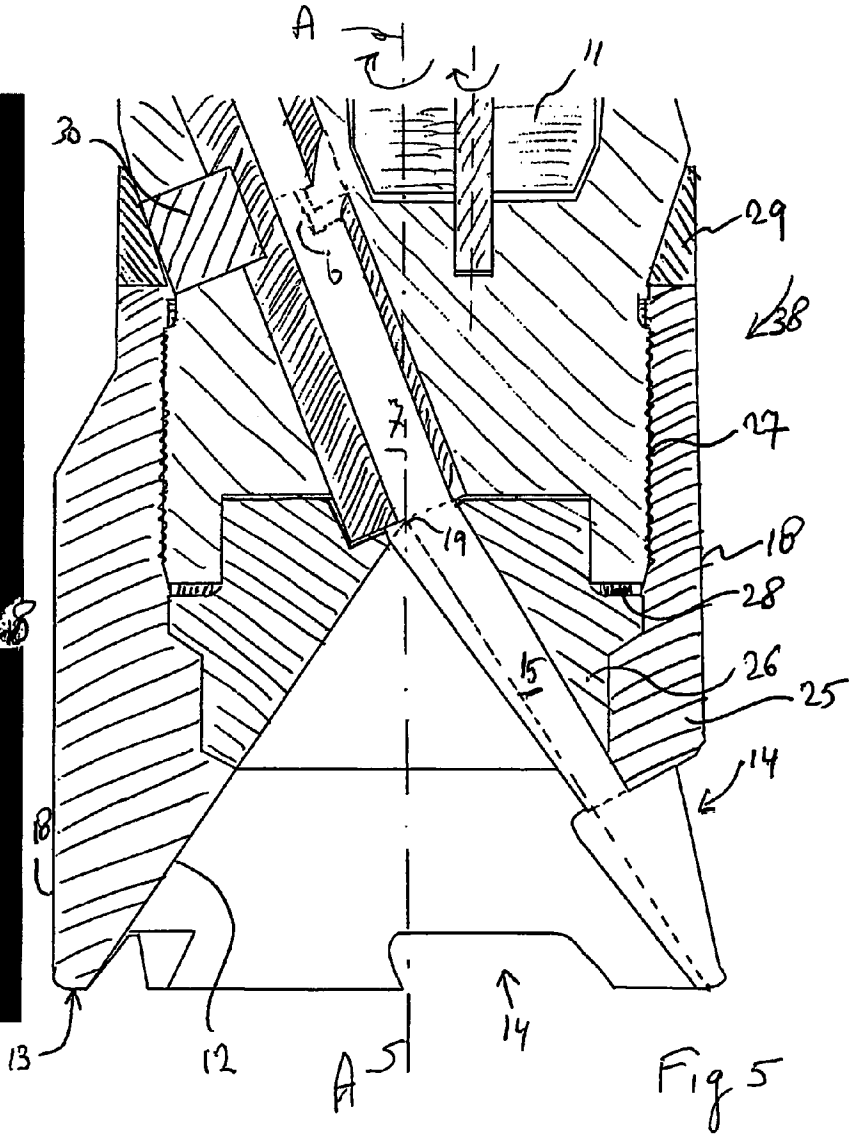
FIG. 5 shows a schematic cross section of the excavating device and distance holder of FIG. 4.

Angle $\alpha$ defined as the top angle between a cross sectional contour of the trumpet shaped inner surface 12 and the axis of rotation A is generally selected between 25° and 55°. In one embodiment, described in detail below with reference to in FIG. 5, $\alpha$ equals 34.5°. Angle $\beta$ of nozzle 7 with axis A should generally lie between $\alpha$ and $\alpha-15°$. In the embodiment of FIG. 5, $\beta=21.8°$ which corresponds to $\alpha-12.7°$. The resulting angle $\gamma$ which is half of the top angle of the heap shaped bottom profile is generally between $\beta+18°$ and $\beta+25°$, depending on how much of the nozzle opening is on the upstream side of the axis A.

Moreover, the discharge channel 15 and/or the opening 16, in combination with the heaped shaped bottom 4, may form an expanding duct which acts as a diffuser allowing for divergence of the abrasive jet stream 9. An advantage of allowing some divergence of the abrasive jet stream 9 is that this facilicates a distance holder of a shorter length measured in the direction of the axis of rotation. This can be understood as follows. With little or no divergence, the abrasivitiy of the jet stream remains high over a relatively large distance from the nozzle outlet. In order to assure that the hole is not excavated too much beyond the peripheral outer surface of the excavating tool, the angle between discharge direction from the nozzle and the advancement direction of the excavating device in the hole has to be chosen smaller leading to an increase in the length of the distance holder relative to its diameter.

Thus, a divergence of minimally 4° is preferably allowed for, more preferably a divergence of minimally 6°. The corresponding angle $\delta$ between the recess wall and the discharge direction of the nozzle 7 is half the divergence angle, and should therefore preferably not be less than 2°, more preferably not less than 3°. The divergence angle preferably does not exceed 30° to insure that the flow of the abrasive fluid in the abrasive jet stream 9 follows the recess contour in order to avoid the occurrence of, for instance, stalling of the abrasive jet stream 9. Angle $\delta$ should therefore preferably not exceed 15° in order to avoid stalling or other unnecessary disturbances of the flow of the abrasive jet stream 9 through the recess 15.

The nozzle 7 is preferably made of a wear resistant, hard material, such as preferably Tungsten Carbide. The distance holder is preferably made of an impact resistant material such as impact resistant steel, or preferably a non-magnetisable and/or high-strength and/or high-temperature resistant and/or corrosion resistant material, such as a high-strength, high-temperature and corrosion resistant nickel-chromium alloy. A nickel-chromium alloy within the following compositional range (in wt. %) has proven particularly suitable:

| | |
|---|---|
| Aluminium | 0.2-0.8 |
| Boron | 0.006 max |
| Carbon | 0.08 max |
| Chromium | 17-21 |
| Cobalt | 1.0 max |
| Copper | 0.3 max |
| Iron | Balance |
| Manganese | 0.35 max |
| Molybdenum | 2.8-3.3 |
| Nickel + Cobalt | 50-55 |
| Niobium + Tantalum | 4.75-5.5 |
| Phosphorus | 0.015 max |
| Silicon | 0.35 max |
| Sulphur | 0.015 max |
| Titanium | 0.65-1.15 |

Such an alloy is commercially available under the name Inconel 718, in accordance with American Metals Societey specifications. The alloy can be age-hardened.

With one or more of the features as set out above, the nozzle discharge direction can be kept almost parallel to the trumpet shaped inner surface of the distance holder, such that the hit zone of the abrasive jet covers at least the full radial length of said trumpet shaped surface. Consequently, the abrasive jet discharge channel 15 in the trumpet shaped inner surface wall of the distance holder 8 runs from at least the center on axis A of the trumpet shaped inner surface 12 to at least the full radius of the distance holder. Both the alignment of the discharge channel 15 through the internal profile and the trumpet shape of that internal profile of the distance holder ensure that all of the bottom hole area is exposed to the abrasive water jet stream during one rotation of the abrasive jet stream.

Advantageously, the excavating device 1 may be provided with a separation system for separating abrasive material out of the mixture flowing downstream impacting the geological formation. Typically such a separation system is provided with a magnetic body 11 for attracting magnetic abrasive particles in the fluid, such that they can be recirculated back into the mixing chamber 6.

It is then of particular advantage that, above the peripheral outer surface section 18, the outside surface 10 of the distance holder 8 converges towards the body of the excavating device 1. Herewith, a larger space is created between the body of the excavating device 1 and the hole wall 3. As a consequence the velocity of the fluid reduces, so that the separation of the magnetic abrasive particles from the fluid is facilitated.

The lower fluid velocity achieved by the converging outside surface 10 is also advantageous in embodiments that are not provided with a separation system, in that undesired washing out of the hole wall 3 by the abrasive particles still present in the fluid is reduced.

In an embodiment wherein the distance holder 8 is provided with one or more slots 14, as described above, at least one of the slots is preferably arranged such that the stream flowing out of the excavating device is directed along the separation system.

If the separation system is not positioned concentrically, in the bore hole the flow through the slots is hereby directed preferably such that the distance between the fluid flow and the separating system is minimized.

An example of a suitable separation system is provided in International publication WO-A-02/34653. Details of an improved separation and recirculation system are given in International application PCT/EP2004/051407, now published under number WO2005/005766, of which priority is claimed and which is hereby incorporated by reference.

Optionally, mechanical cutting elements are arranged on the distance holder in either of the disclosed embodiments, for supporting the hole making capacity of the excavating tool. In particular, one or more of the group consisting of the trumpet-shaped inner surface section 12, the outer surface 10, and the contact end surface 13, or the rim area, can be provided with cutting elements.

In a special embodiment cutting elements are optionally arranged in the forward directed wall of the junk slots 14 in relation to the direction of rotation. The excavating device is rotated and when a junk slot 14 is arranged in the contact surface 13 it is possible that cuttings or particles falling out of the wall of the excavated hole get caught between the junk slot 14 and the bore hole wall 3. This may hamper the rotation of the excavating device 1 or may damage the distance holder 8. By providing cutting elements in the junk slots, these particles could be cut when they get jammed into the junk slot.

Cutting elements on the outer surface can provide a finishing of the bore hole wall. For some sensors, which are run into the hole after the drilling, this might be preferred if a good contact between the bore wall hole and these devices is required.

Figure 4:
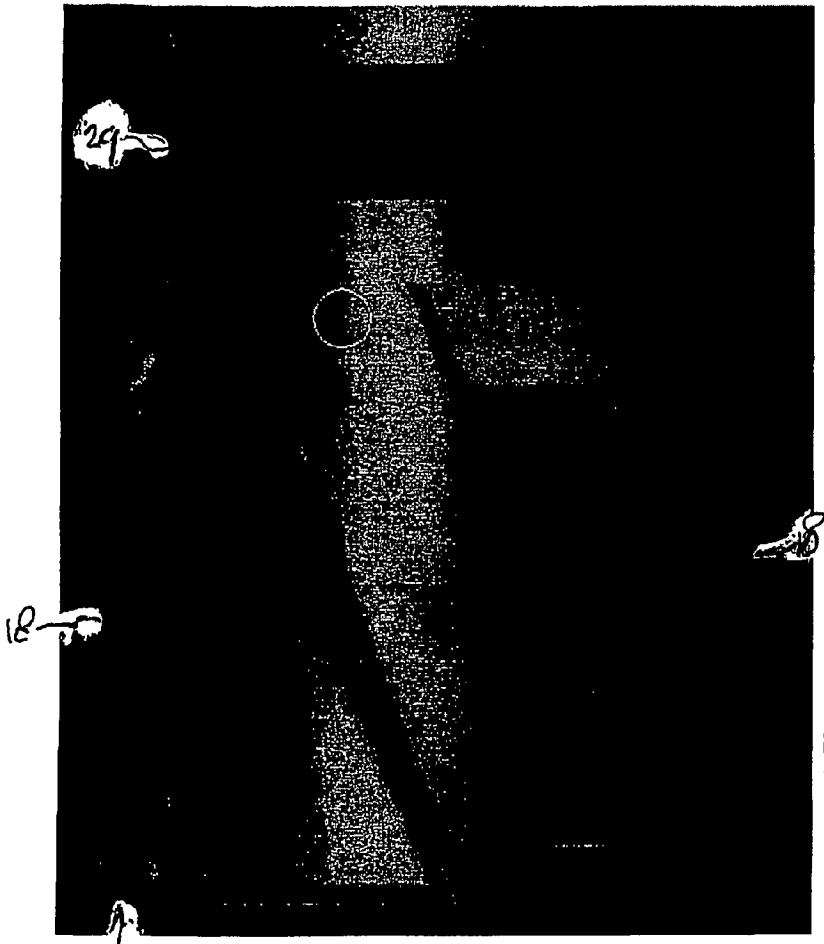
FIG. 4 shows a schematic side view of a second embodiment of an excavating device with a distance holder according to the invention.

Alternative embodiments of a distance holder 38 and excavating device are shown in FIGS. 4 and 5, whereby FIG. 4 shows a side view and FIG. 5 a cross sectional view. Parts having reference numerals that have already been introduced above will not be described in detail again.

The alternative distance holder 38 is firmly connectable to the abrasive jet stream generating tool part by means of a connector in the form of a threaded connection 27. The alternative distance holder is an assembly of parts each being made of a particularly suitable material.

There is provided an outer part 25 for direct contact with the geological formation and taking mechanical impacts, and a relatively wear resistant inner part 26 through which the recess 15 is predominantly provided.

The outer part can suitably be made of an impact resistant material such described above in relation with the distance holder of FIGS. 2A to 2C. The inner part 26 is formed as an insert which can be held in place between the outer part 25 and the abrasive jet stream generating tool part.

The inner part 26 can be made of an abrasion-resistive hard material, preferably a Tungsten-Carbide, to avoid as much as possible wear resulting from the abrasive jet stream 9 which glancingly passes along the inner part 26. It can be made of the same material as nozzle 7. Because of the presence of the outer part 25, the inner part 26 can be relatively brittle, and the outer part 25 can be somewhat less wear resistant than in an embodiment where the distance holder is formed out of a unitary part.

A distance ring 28 is provided to maintain a distance in the axial direction between the inner part 26 and the abrasive jet stream generating tool part. Herewith it is achieved that any load is transmitted exclusively between the outer part 25 and the abrasive jet stream generating tool part, such that the inner part 26 does not excert a load on the nozzle 7. The distance ring 28 also serves to accommodate a slight forward movement of the nozzle 17 that may result from the force associated with the pressure drops in the drilling fluid imposed by the first and second nozzles.

The separating system, which includes magnet 11 as described above with reference to FIG. 1, is here provided eccentrically with respect to axis A.

A para-magnetic attractor body 30 is provided adjacent the mixing chamber 6 on a side thereof opposite that of the magnet 11. The para-magnetic attractor body 30 is magnetisable under the magnetic field generated by magnet 11, and facilitates the release of para-magnetic abrasive particles into the mixing chamber 6. An annular cover ring 29 is provided to enclose the magnetic attractor body 30. The cover ring 29 can be held in position against the abrasive jet stream generating tool part by the distance holder 38. A similar construction can be provided in the embodiment of FIGS. 1 and 2.

I claim:

1. A distance holder for use as a part of an excavating device arranged to generate a stream of an abrasive fluid to be jetted against a geological formation thereby excavating a hole in the geological formation, the distance holder having a wall with a trumpet shaped inner surface section to be facing the geological formation there where it is to be excavated, whereby a recess is formed in the trumpet shaped inner surface section of the wall thereby defining an opening in the trumpet shaped inner surface section to allow the stream of the abrasive fluid to pass from within the recess through the trumpet shaped inner surface section to impact the geological formation, wherein the trumpet shaped inner surface converges in a centre area, whereby the opening extends to include the centre area.

2. The distance holder according to claim 1, wherein the opening has an elongate contour.

3. The distance holder according to claim 2, wherein the elongate contour is elongate in a direction radially outward from the centre area.

4. The distance holder according to claim 1, wherein the recess forms a cavity in said trumpet shaped inner surface section for the abrasive jet stream to pass through.

5. The distance holder according to claim 1, further comprising a peripheral outer surface section, which is connected to the trumpet shaped inner surface section via a rim area, wherein the opening in the trumpet shaped inner surface extends to the rim area.

6. The distance holder according to claim 5, wherein the rim area is provided with one or more slots for drainage of the abrasive fluid.

7. The distance holder according to claim 6, wherein the peripheral outer surface includes one more recesses and said one or more slots extend to said one or more recesses in the peripheral outer surface section.

8. The distance holder according to claim 6, wherein the opening in the trumpet shaped inner surface extends into one of the one or more slots.

9. The distance holder according to claim 1, further provided with one or more cutting elements for mechanically cutting into the geological formation.

10. The distance holder according to claim 1, wherein peripheral outer surface includes one more recesses and the one or more slots extend to said one or more recesses in the peripheral outer surface section.

11. An excavating device for excavating a hole in a geological formation, which excavating device has a proximal end and a distal end formed by a distance holder having a wall with a trumpet shaped inner surface section to be facing the geological formation there where it is to be excavated, whereby a recess is formed in the trumpet shaped inner surface section of the wall thereby defining an opening in the trumpet shaped inner surface section to allow the stream of the abrasive fluid to pass from within the recess through the trumpet shaped inner surface section to impact the geological formation, which excavating device further comprises:

a body rotatable inside the hole along a rotation axis;

a nozzle arranged on the body to jet a stream of an abrasive fluid onto a surface in the geological formation in order to generate the hole, wherein the stream of the abrasive fluid has at least a radial velocity component and one parallel to the rotation axis; whereby the distance holder is arranged on the body to ensure a predefined distance between the nozzle outlet and the surface in the geological formation and whereby the nozzle is arranged to discharge in the recess that is formed in the inner surface of the wall of the distance holder, wherein the trumpet shaped inner surface of the distance holder converges in a centre area in the axis of rotation, whereby the opening extends to include the centre area.

12. The excavating device of claim 11, wherein the nozzle discharge direction is substantially parallel to the trumpet shaped inner surface of the distance holder.

13. The excavating device of claim 11, wherein the opening is an elongate shaped opening of which the direction of elongation is aligned with the discharge direction of the nozzle.

14. The excavating device according to claim 11, wherein the outer surface section of the distance holder is provided with one or more slots for drainage of the abrasive fluid, whereby at least one of the slots is located in the same azimuthal position relative to the excavation device as in which the stream of the abrasive fluid is directed.

15. The excavating device according to claim 14, wherein cutting elements are arranged in the slot on a forward facing side in relation to the direction of rotation.

16. The excavating device according to claim 14, comprising a separation system for separating abrasive material out of the stream flowing out of the excavating device and recirculating the abrasive material back into the abrasive fluid in the nozzle, wherein the slot is arranged such that the stream flowing out of the excavating device is directed along the separation system.

17. The distance holder according to claim 11, further comprising a peripheral outer surface section, which is connected to the trumpet shaped inner surface section via a rim area, wherein the opening in the trumpet shaped inner surface extends to the rim area.

18. The distance holder according to claim 17, wherein the rim area is provided with one or more slots for drainage of the abrasive fluid.

* * * * *